US005111974A

United States Patent [19]

Parker

[11] Patent Number: 5,111,974

[45] Date of Patent: May 12, 1992

[54] DISPENSERS FOR GASIFIED BEVERAGES

[75] Inventor: Alan Parker, Kent, England

[73] Assignee: Reed Pakaging Limited, Kent, England

[21] Appl. No.: 354,410

[22] Filed: May 17, 1989

[30] Foreign Application Priority Data

May 18, 1988 [GB] United Kingdom ..... 8811759

[51] Int. Cl.[5] ..... B65D 83/00

[52] U.S. Cl. ..... 222/399; 222/400.7; 222/402.13; 222/183

[58] Field of Search ..... 222/399, 400.7, 402.13, 222/402.14, 394, 183; 137/505.13, 505.25, 212, 588

[56] References Cited

U.S. PATENT DOCUMENTS

| | | | |
|---|---|---|---|
| 2,720,342 | 10/1955 | Fleck | 222/195 |
| 3,119,544 | 1/1964 | Cope et al. | 222/183 X |
| 3,246,825 | 4/1966 | Zastrow | 222/183 X |
| 3,349,965 | 10/1967 | Krugger | 222/399 X |
| 3,373,907 | 3/1968 | Batrow | 222/399 |
| 3,499,582 | 3/1970 | Berney | 222/183 |
| 3,612,354 | 10/1971 | Sitton | 222/399 X |
| 4,785,977 | 11/1988 | Ball | 222/402.14 |
| 4,804,116 | 2/1989 | Ball | 222/399 X |

FOREIGN PATENT DOCUMENTS

| | | |
|---|---|---|
| 410953 | 9/1935 | Belgium . |
| 0186709 | 7/1986 | European Pat. Off. . |
| 217615 | 4/1987 | European Pat. Off. . |
| 98965 | 8/1898 | Fed. Rep. of Germany . |
| 564717 | 1/1924 | France . |
| 2297173 | 8/1976 | France . |
| 88/01981 | 3/1988 | PCT Int'l Appl. . |
| 89/00544 | 1/1989 | PCT Int'l Appl. . |
| 423618 | 11/1964 | Switzerland . |
| 16087 | of 1897 | United Kingdom . |
| 26340 | of 1898 | United Kingdom . |
| 922347 | 3/1963 | United Kingdom . |
| 1013287 | 12/1965 | United Kingdom . |
| 938528 | 10/1968 | United Kingdom . |
| 1135971 | 12/1968 | United Kingdom . |
| 1177288 | 1/1970 | United Kingdom . |
| 1236645 | 6/1971 | United Kingdom . |
| 1293195 | 10/1972 | United Kingdom . |
| 1504986 | 3/1978 | United Kingdom . |
| 2180890 | 4/1987 | United Kingdom . |
| 2185537 | 7/1987 | United Kingdom . |
| 2194938 | 3/1988 | United Kingdom . |
| 2217787 | 11/1989 | United Kingdom . |

*Primary Examiner*—David H. Bollinger
*Attorney, Agent, or Firm*—Lyon & Lyon

[57] ABSTRACT

A dispenser for a gasified beverage comprising a housing (1), a container (5) of gasified beverage in said housing, a container (8) of gas in said housing for topping up the beverage container with gas, and a single dispensing valve unit (4) operatively connected to both of said containers and manually accessible to the user, said valve unit being so arranged, as, when operated, both to dispense the beverage and to cause topping up gas to be released from the gas container and supplied to the beverage container.

17 Claims, 5 Drawing Sheets

DISPENSERS FOR GASIFIED BEVERAGES

This invention relates to dispensers for gasified beverages which are supplied to the user in a suitable container and in a ready to drink, gasified, condition. Examples of such beverages are lemonade, beer and other more or less "fizzy" drinks, which are usually gasified by means of carbon dioxide ($CO_2$), or a mixture of gases.

Often, such beverages are supplied to the user in relatively small containers, such as cans or bottles of a size of the order of a half-pint, all of whose contents will be used at a single time, and the beverage is then enjoyed in its pristine condition, straight from the previously sealed container. However, if the beverage is supplied to the user in a larger container, for example of one or two litres capacity, the whole contents of the container will often not be used at a single time, and the problem then arises that the degree of gasification, and thus the quality, of the beverage which is left in the container is reduced due to loss of gas into the empty space left in the container. Indeed, the remaining beverage may eventually go more or less "flat" after repeated opening and closing of the container.

It has been proposed, as disclosed for example in GB-A-2180890, to provide such a beverage container, in a suitable housing, in combination with a container of $CO_2$, together with valving arrangements operable by the user to top up the beverage container with $CO_2$ whenever some of the beverage is dispensed. However, in this previous proposal it has been necessary for the user separately to operate valves for initially releasing $CO_2$ from the $CO_2$ container and subsequently dispensing the beverage and topping up the beverage container with $CO_2$, which is an undesirably complicated procedure for the non-technical, e.g. domestic, end user.

Viewed from one aspect the present invention provides a dispenser for a gasified beverage comprising a housing, a container of gasified beverage in said housing, a container of gas in said housing for topping up the beverage container with gas, and a single dispensing valve unit operatively connected to both of said containers and manually accessible to the user, said valve unit being so arranged, as, when operated, both to dispense the beverage and to cause topping up gas to be released from the gas container and supplied to the beverage container.

Preferably the said dispensing valve unit is mounted directly to the outlets of the two containers, of beverage and topping up gas respectively, to avoid the use of any pipe-work therebetween which might be prone to leakage problems in use.

Preferably the beverage container is mounted and supported in a partially or wholly inverted condition with its outlet connected directly into the said dispensing valve unit. As a result the beverage container may be of a very simple and inexpensive type, without a dio tube or any other failure-prone means for extracting the beverage from the container. For example a container of the well known PE (polyethylene terephthalate) type may be used. The container of topping up gas may equally well be mounted and supported in a partially or wholly inverted condition, again with its outlet connected directly to the valve unit.

Thus in a preferred form of the invention both of the said containers are mounted and located in the housing in an at least partially inverted condition, generally above the said dispensing valve unit, which unit is located at a bottom region of the housing, adjacent an outer wall thereof, conveniently accessible to the user. In a particularly preferred arrangement the beverage container is mounted in an inclined inverted position, transversely of the housing, the gas container is mounted in a substantially vertical inverted position on one side of the housing, and the valve unit is located adjacent a bottom edge of the housing, immediately below the gas container. In a preferred form of such an arrangement the beverage container is supported on the floor of the housing, the valve unit is suspended from the outlet of the beverage container and also supported by the housing floor, and the gas container is mounted on and supported by the valve unit.

The said housing of the dispenser preferably comprises a box made of cardboard, corrugated board, or similar light-weight foldable material, preferably formed from a one-piece blank. It is preferably arranged to be supplied to the user as a closed box with a portion which is removable to provide user access to the said dispensing valve unit. It is also preferably provided with a carrying handle. Further features of a preferred form of such a box, in particular features thereof which provide support for the two containers and the valve unit therein, will become clear from the following description of an embodiment of the invention.

The said dispensing valve unit may take various forms within the confines of the necessary features thereof referred to hereinbefore. However, it is preferably as disclosed in our patent application No. 353,894 of even date herewith.

An embodiment of the invention will now be described by way of example and with reference to the accompanying drawings, in which.

Figure 1:
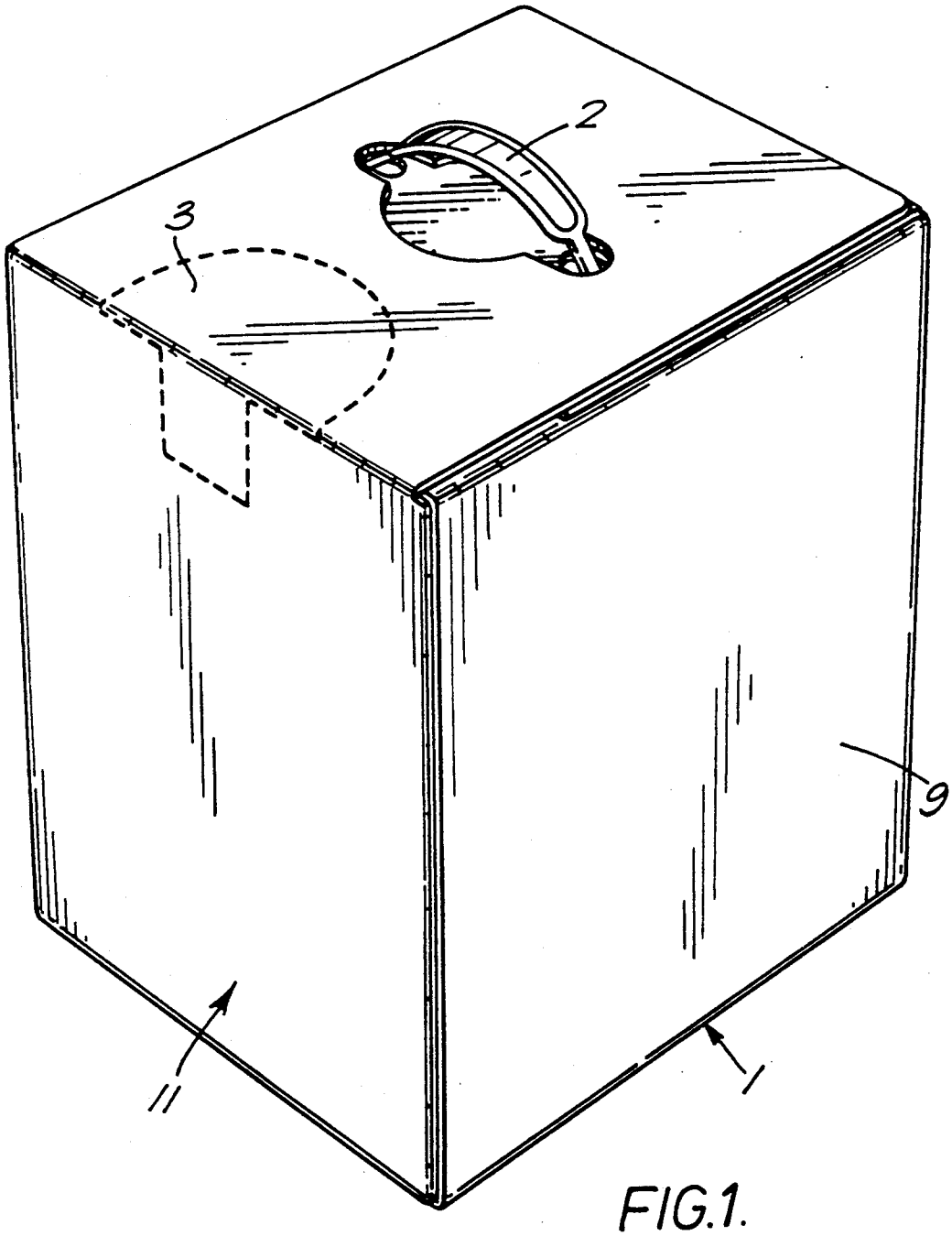
FIG. 1 is a perspective view of a beverage dispenser according to the invention, in its closed condition as supplied to a user.

Referring first to FIG. 1, a beverage dispenser according to the invention, as provided to e.g. a domestic user, comprises a housing in the form of a closed cardboard box 1 provided with a carrying handle 2 and formed with a portion 3, extending around one edge of the box, which is readily removable by way of perforations to expose the dispensing valve unit of the dispenser.

Figure 2:
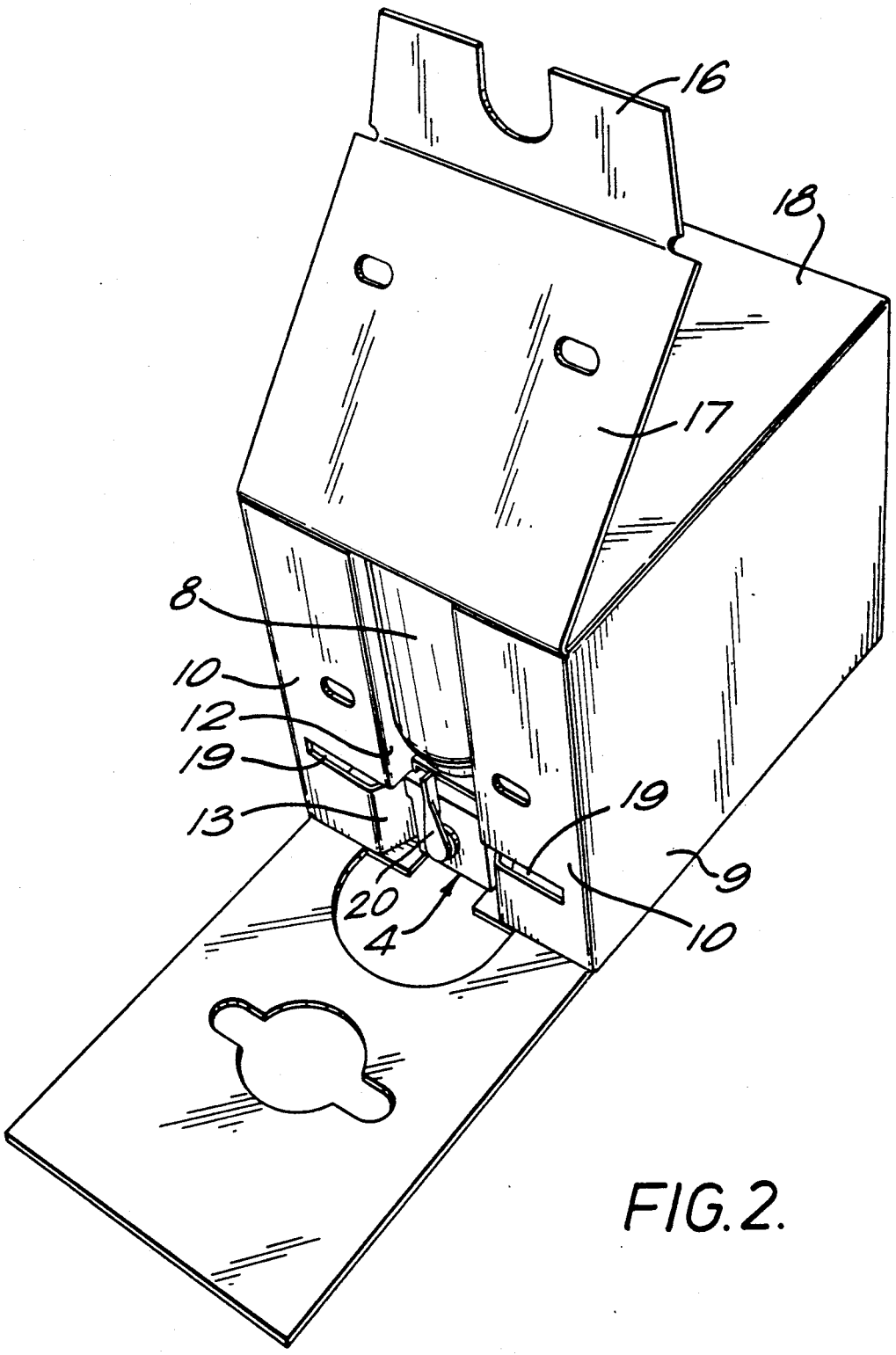
FIG. 2 shows the dispenser turned on its side from the (carrying) condition of FIG. 1, to its condition of use, but with the housing partly opened to show the interior structure.
Figure 3:
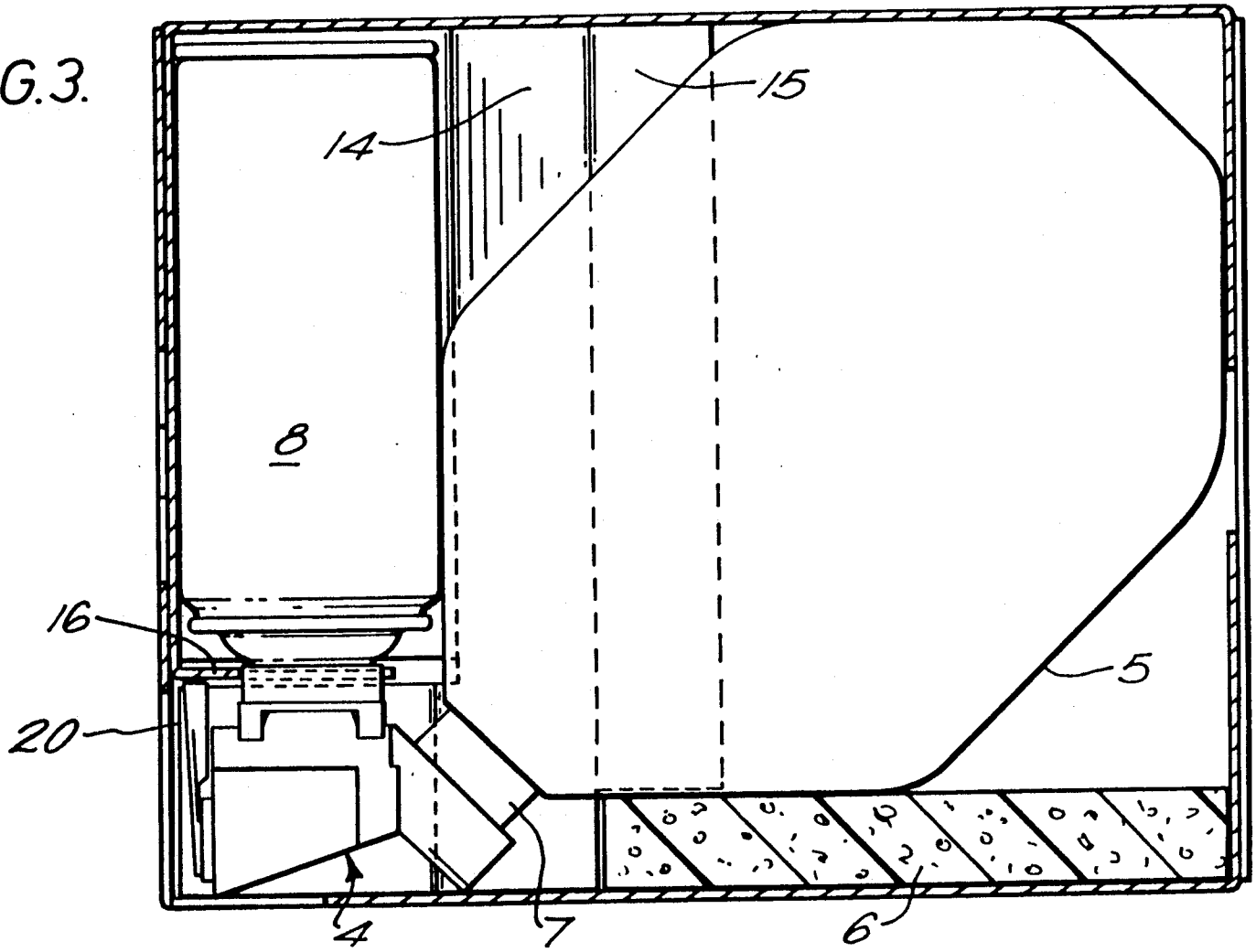
FIG. 3 is a transverse vertical cross-section of the dispenser in its condition of use.
Figure 4:
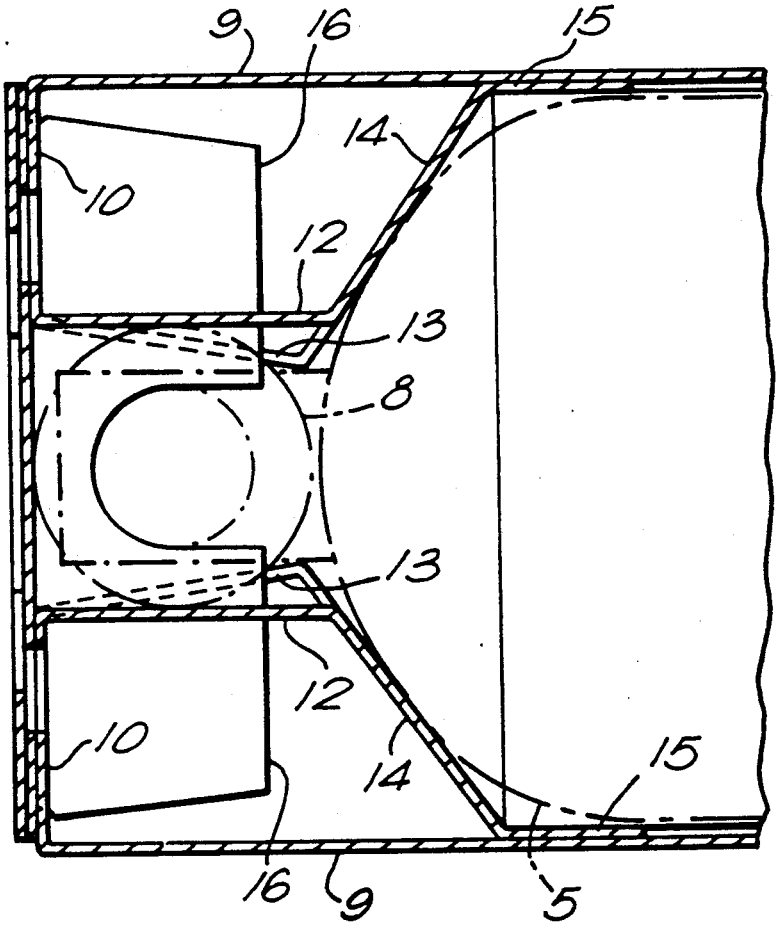
FIG. 4 is a partial horizontal cross-section.

In use, and referring now to FIGS. 2 to 4, the box is turned on its side from the FIG. 1 position and the portion 3 is removed to expose the dispensing valve unit 4. Other than this, the box is not disassembled by the user, the illustration of the box in its partly disassembled form in FIG. 2 being only for the purpose of the present description of its internal features.

Referring particularly to FIG. 3, a beverage container in the form of a PET bottle 5 is supported in the box on a block 6 in an inclined inverted position so that its outlet 7 points downwards towards the dispensing valve unit 4, which unit is sealingly connected to the bottle outlet to receive the beverage therefrom by gravity flow, assisted by the gas pressure above the liquid. A gas container in the form of an aerosol can 8 containing $CO_2$, or $CO_2$ and other mixed gases, is mounted on and sealingly connected to the valve unit, in a vertical inverted position. Both the beverage container 5 and the gas container 8 engage with and are laterally supported by the side walls of the box, and indeed the interconnected combination of the two containers and the valve unit is a snug fit in the box so as to be firmly supported all round by the walls of the box both durino transportation and storage (in the FIG. 1 position) and in use.

The PET bottle 5 is preferably shaped to have a longitudinal axis of symmetry, as shown, so as to permit its connection to the dispensing valve in any position of axial rotation. The base of the bottle, although it could be hemispherical or of other shapes, is preferably of substantially frustroconical form as illustrated, so as to maximise use of the available space, and to increase the area of contact between the bottle and the inside walls of the box, for stability during transportation and use.

Referring particularly to FIGS. 2 and 4, the side walls 9 of the box are provided with hinged extensions whose successively hingedly interconnected panels comprise, firstly, panels 10 forming innermost layers of the end wall 11 of the box, secondly upper and lower panel portions 12 and 13 which laterally support the gas container 8 and the valve unit 4 respectively, thirdly panels 14 which laterally support the beverage container 5, and lastly flaps 15 which tuck in between the container 5 and the side walls of the box to stabilise this panel structure.

The supporting structure within the box is completed by a flap 16 on a panel 17 hinged to the top wall 18 of the box, which flap 16 tucks through slots 19 in the panels 10 and provided underneath support for the gas container 8.

Figure 5:
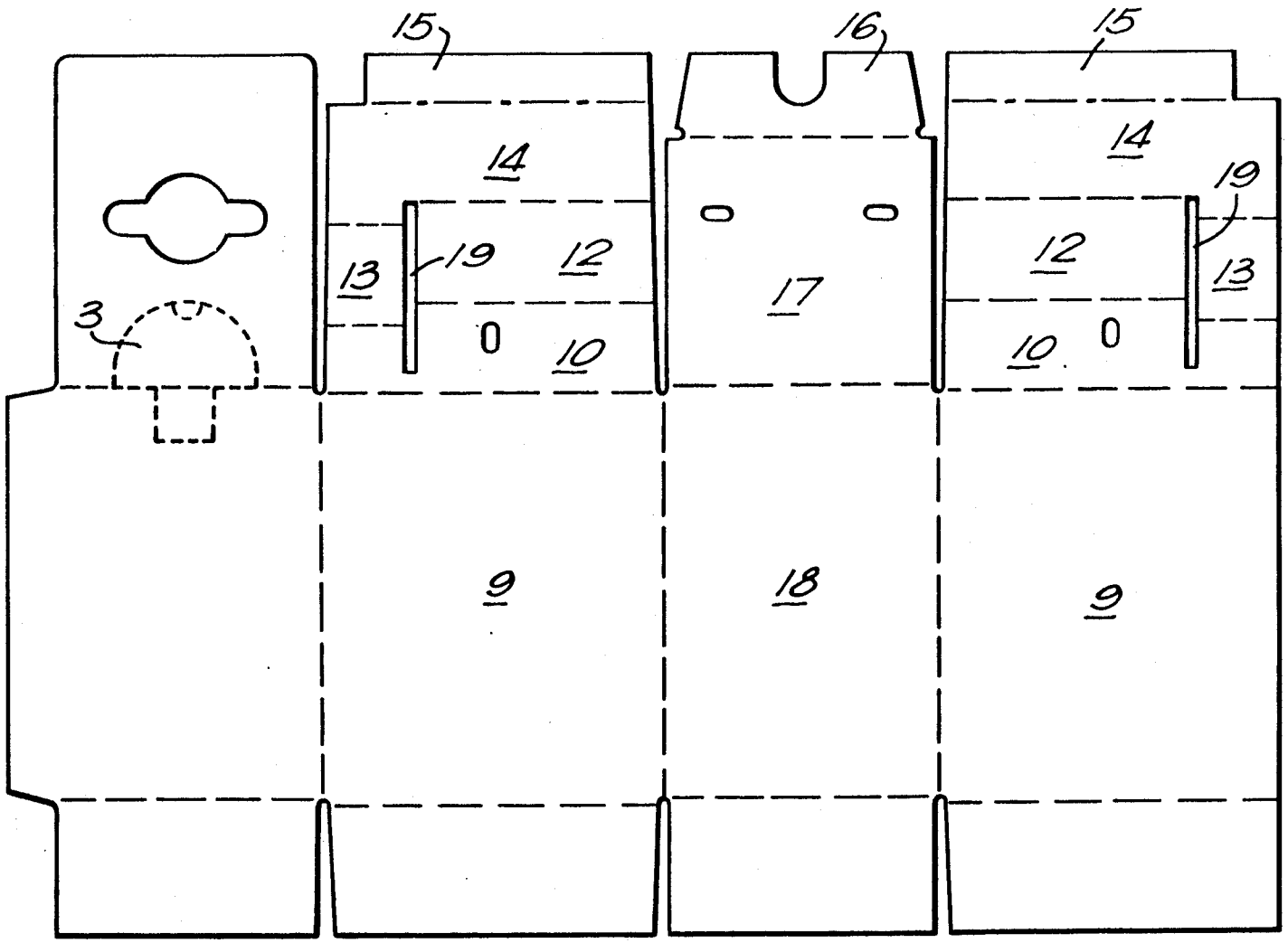
FIG. 5 is a plan view of a cardboard blank for making the housing.

The various parts of the box as described above are also identified in the blank for making the box, shown in FIG. 5.

The dispensing valve unit 4 is as disclosed in our patent application No. 353,894, mentioned previously, to which reference may be made for further details. Briefly, the valve unit has an upstanding operating handle 20 which, when rotated in either direction, has the effect of opening the (conventional) valve of the gas container 8 during a first part of its movement, so as to charge a chamber in the valve unit with pressurised $CO_2$ from the container, and then, during the next part of its movement, both opening a flow path for the beverage out of the container 5 and through the valve unit to the exterior (via a dispensing orifice in the underside of the valve unit) and opening a flow for the pressurised $CO_2$ from the said chamber into the beverage container so as to top up the same with $CO_2$. Returning the operating handle to its vertical position closes the said flow paths, in the reverse order.

I claim:

1. A dispenser for a gasified beverage comprising a walled housing, a container of gasified beverage in said housing, a container of pressurized gas in said housing for topping pu the beverage container with gas, said containers each having an outlet with said outlets positioned adjacent each other in said housing, said gas container having a normally-closed outlet valve on its outlet, and a single dispensing valve unit directly mounted on the outlets of both said containers and manually accessible to the user, said valve unit including a valve member such that, when operated, to physically open said normally-closed outlet valve to admit pressurized gas to said dispensing valve unit, for the same operation of said valve unit to open the outlet of the beverage container to dispense the beverage from the beverage container, and for the same operation of said valve unit also to cause topping up gas to be released from the gas container and supplied to the beverage container, said normally-closed outlet valve returning to a closed condition when said operation of said valve unit is discontinued.

2. A dispenser as claimed in claim 1, wherein the said beverage container is mounted and supported in the said housing in at least a partially inverted condition, for gravity feed of the beverage to the said dispensing valve unit in use.

3. A dispenser as claimed in claim 2, wherein the said container of topping up gas is mounted and supported in the said housing in at least a partially inverted condition.

4. A dispenser as claimed in claim 3, wherein the beverage container is mounted in an inclined inverted position, transversely of the housing, the gas container is mounted in a substantially vertical inverted position on one side of the housing, and the valve unit is located adjacent a bottom edge of the housing, immediately below the gas container.

5. A dispenser as claimed in claim 4, wherein the beverage container is supported on the floor of the housing, the valve unit is suspended from the outlet of the beverage container and also supported by the housing floor, and the gas container is mounted on and supported by the valve unit.

6. A dispenser as claimed in claim 5, wherein the beverage container and the gas container are laterally supported by side walls of the housing.

7. A dispenser as claimed in claim 6, wherein the interconnected combination of the two containers and the valve unit is a snug fit in the housing so as to be firmly supported all round by the walls of the housing.

8. A dispenser as claimed in claim 1, wherein the said housing comprises a box made of light-weight foldable material, such as cardboard, or corrugated board.

9. A dispenser as claimed in claim 8, wherein the said housing is a closed box with a portion which is removable to provide user access to the said dispensing valve unit.

10. A dispenser for a gasified beverage comprising a walled housing, a container of gasified beverage in said housing, a container of gas in said housing for topping up the beverage container with gas, and a single dispensing valve unit operatively connected to both of said containers and manually accessible to the user, said valve unit being so arranged, as, when operated, both to dispense the beverage and to cause topping up gas to be released from the gas container and supplied to the beverage container, wherein said housing comprises a box of a light-weight foldable material, and wherein two of the side walls of the said box are provided with hinged extensions whose successively hingedly interconnected panels comprise, firstly, panels forming innermost layers of an adjacent end wall of the box, secondly, upper and lower panel portions which laterally support said gas container and said valve unit respectively, thirdly, panels which laterally support the said beverage container, and lastly, flaps which tuck in between the beverage container and the said side walls of the box to stabilize this panel structure.

11. A dispenser as claimed in claim 10, wherein the said beverage container is mounted and supported in the said housing in at least a partially inverted condition, for gravity feed of the beverage to the said dispensing valve unit in use.

12. A dispenser as claimed in claim 10, wherein the said container of topping up gas is mounted and supported in the said housing in at least a partially inverted condition.

13. A dispenser as claimed in claim 12, wherein the beverage container is mounted in an inclined inverted position, transversely of the housing, the gas container is mounted in a substantially vertical inverted position on one side of the housing, and the valve unit is located adjacent a bottom edge of the housing, immediately below the gas container.

14. A dispenser as claimed in claim 10, wherein the beverage container is supported on the floor of the housing, the valve unit is suspended from the outlet of the beverage container and also supported by the housing floor, and the gas container is mounted on and supported by the valve unit.

15. A dispenser as claimed in claim 10, wherein the interconnected combination of the two containers and the valve unit is a snug fit in the housing so as to be firmly supported all round by the walls of the housing.

16. A dispenser as claimed in claim 10, wherein the said housing is comprised of cardboard.

17. A dispenser as claimed in claim 10, wherein the said housing is a closed box with a portion which is removable to provide user access to the said dispensing valve unit.

* * * * *